US005135220A

United States Patent [19]

Baldoni

[11] Patent Number: 5,135,220

[45] Date of Patent: Aug. 4, 1992

[54] GOLF BALL POSITION MARKER APPARATUS

[76] Inventor: Lee Baldoni, 2229 S. 14th St., Springfield, Ill. 62703

[21] Appl. No.: 756,472

[22] Filed: Sep. 9, 1991

[51] Int. Cl.[5] ..... A63B 57/00

[52] U.S. Cl. ..... 273/32 A; 273/32 H; 73/188

[58] Field of Search ..... 273/32 A, 32 H, 32 B, 273/162 D; 73/188, 189

[56] References Cited

U.S. PATENT DOCUMENTS

| | | | |
|---|---|---|---|
| 3,136,547 | 6/1964 | Schaper | 273/32 A |
| 3,233,802 | 2/1966 | Ludwick | 273/32 A |
| 4,854,579 | 8/1989 | Baxter | 273/32 H |
| 4,864,854 | 9/1989 | van Leemput | 273/32 H |

FOREIGN PATENT DOCUMENTS

| | | | |
|---|---|---|---|
| 1369506 | 10/1974 | United Kingdom | 273/32 A |

*Primary Examiner*—Paul E. Shapiro
*Assistant Examiner*—Mark S. Graham
*Attorney, Agent, or Firm*—Leon Gilden

[57] ABSTRACT

A golf ball position indicator device includes a ferrous metallic disc mounted to a ferrous metallic housing. The housing is mounted fixedly to a flexible elongate web, including a clasp arrangement to secure the web about a golfer's wrist, wherein the marker may be conveniently and readily removed relative to the magnetic housing. A modification of the invention includes the housing including a wind indicator vane mounted hingedly within the housing for providing visual indication of wind direction to assist a golfer in club selection and angle of attack in a golfing game.

3 Claims, 4 Drawing Sheets

GOLF BALL POSITION MARKER APPARATUS

BACKGROUND OF THE INVENTION

1. Field of the Invention

The field of invention relates to golf game apparatus, and more particularly pertains to a new and improved golf ball position marker apparatus wherein the same is arranged for the convenient mounting and positioning of a golf ball marker for use during a golf game.

2. Description of the Prior Art

Typically in the playing of a golf game, a marking device such as a coin is frequently positioned upon a golf green to provide for indication of a player's golf ball such that a further player may play relative to an associated target cup. While prior art devices have been utilized to secure various golf ball markers, the prior art has not set forth a marker structure as set forth by the invention for ease of securement of the markers in a wrist supported configuration as set forth by the invention. For example, U.S. Pat. No. 4,530,500 to Kaymen sets forth a marker storage device of a clip bound structure mounting a marker disc magnetically thereon.

U.S. Pat. No. 3,895,797 to Moore sets forth a golf ball marker utilizing a hook and loop fastener structure to mount the support pad to a garment and the marker to the pad.

U.S. Pat. No. 4,489,444 to Graham wherein a golf ball position marker has a pad joined with a flap utilizing confronting hook and loop fastener structure to releasably grip one another to mount a golf ball marker therebetween.

As such, it may be appreciated that there continues to be a need for a new and improved golf ball position marker apparatus as set forth by the instant invention which addresses both the problems of ease of use as well as effectiveness in construction and in this respect, the present invention substantially fulfills this need.

SUMMARY OF THE INVENTION

In view of the foregoing disadvantages inherent in the known types of golf ball marker apparatus now present in the prior art, the present invention provides a golf ball position marker apparatus wherein the same is arranged to provide for a wrist supported magnetic housing to releasably mount a ferromagnetic marker disc thereon. As such, the general purpose of the present invention, which will be described subsequently in greater detail, is to provide a new and improved golf ball position marker apparatus which has all the advantages of the prior art golf ball marker apparatus and none of the disadvantages.

To attain this, the present invention provides a golf ball position indicator device including a ferrous metallic disc mounted to a ferrous metallic housing. The housing is mounted fixedly to a flexible elongate web, including a clasp arrangement to secure the web about a golfer's wrist, wherein the marker may be conveniently and readily removed relative to the magnetic housing. A modification of the invention includes the housing including a wind indicator vane mounted hingedly within the housing for providing visual indication of wind direction to assist a golfer in club selection and angle of attack in a golfing game.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved golf ball position marker apparatus which has all the advantages of the prior art golf ball marker apparatus and none of the disadvantages.

It is another object of the present invention to provide a new and improved golf ball position marker apparatus which may be easily and efficiently manufactured and marketed.

It is a further object of the present invention to provide a new and improved golf ball position marker apparatus which is of a durable and reliable construction.

An even further object of the present invention is to provide a new and improved golf ball position marker apparatus which is susceptible of a low cost of manufacture with regard to both materials and labor, and which accordingly is then susceptible of low prices of sale to the consuming public, thereby making such golf ball position marker apparatus economically available to the buying public.

Still yet another object of the present invention is to provide a new and improved golf ball position marker apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
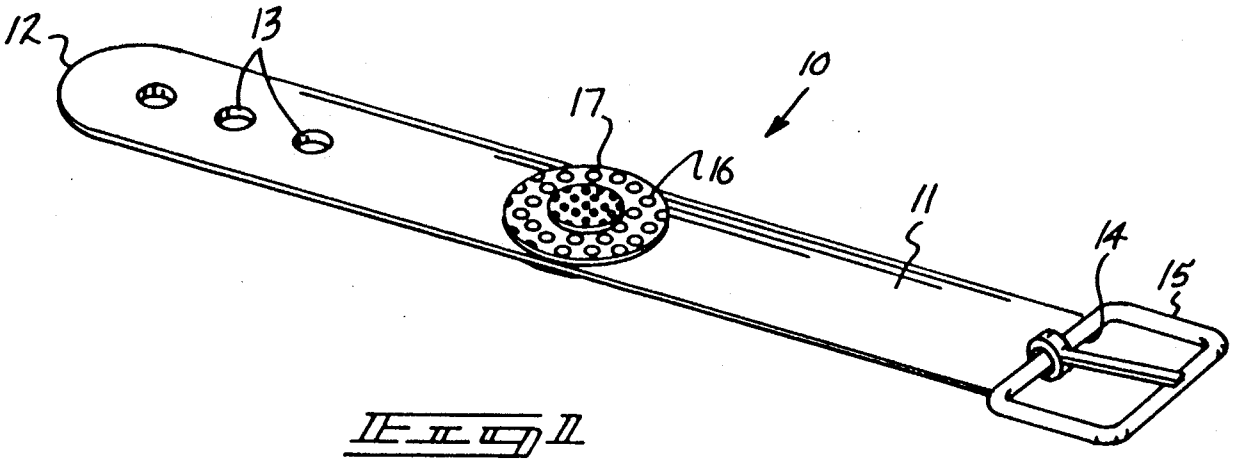
FIG. 1 is an isometric illustration of the instant invention.
Figure 2:
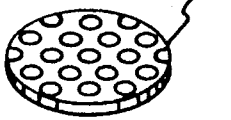
FIG. 2 is an isometric illustration of the marker disc utilized by the invention.
Figure 3:
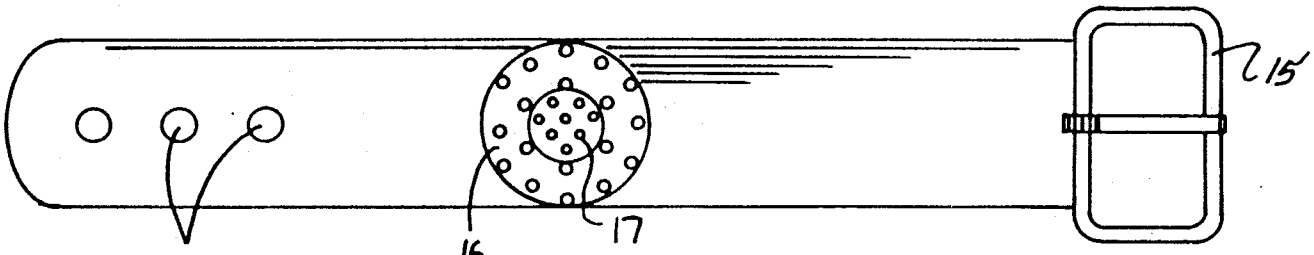
FIG. 3 is an orthographic top view of the instant invention.
Figure 4:
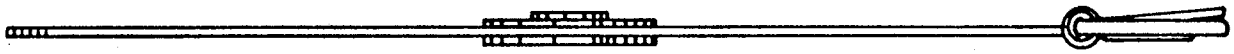
FIG. 4 is an orthographic side view of the instant invention.
Figure 5:
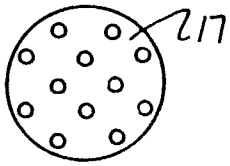
FIG. 5 is an orthographic top view of the marker disc.
Figure 6:
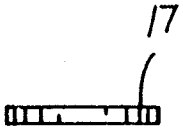
FIG. 6 is an orthographic side view of the marker disc.

With reference now to the drawings, and in particular to FIGS. 1 to 13 thereof, a new and improved golf ball position marker apparatus embodying the principles and concepts of the present invention and generally designated by the reference numeral 10 will be described.

More specifically, the golf ball position marker apparatus 10 of the instant invention essentially comprises a flexible elongate web 11, including a first web distal end 12 spaced from a second web distal end 14. A series of aligned apertures 13 spaced apart at equal spaced intervals relative to one another and longitudinally aligned relative to the web 11 are arranged to receive a buckle member 15 mounted to the second distal end 14 for securement of the web 11 about an individual's wrist. A ferromagnetic cylindrical housing 16 is mounted medially of the web 11 and whose housing is bisected by the web along an axial length defined by the cylindrical housing 16. The top surface of the housing 16 is arranged to magnetically adhere a ferrous metallic marking disc 17 thereon that may be provided with contrasting colorations or patterns for its ease of viewing in a golf ball marking event. The bottom surface of the housing 16 projecting below an associated bottom surface of the web 11 is in contiguous communication with an individual's wrist surface to thereby prevent undesirable rotation of the web 11 about the individual's wrist by the frictional engagement of the bottom surface of the housing 16.

Figure 7:
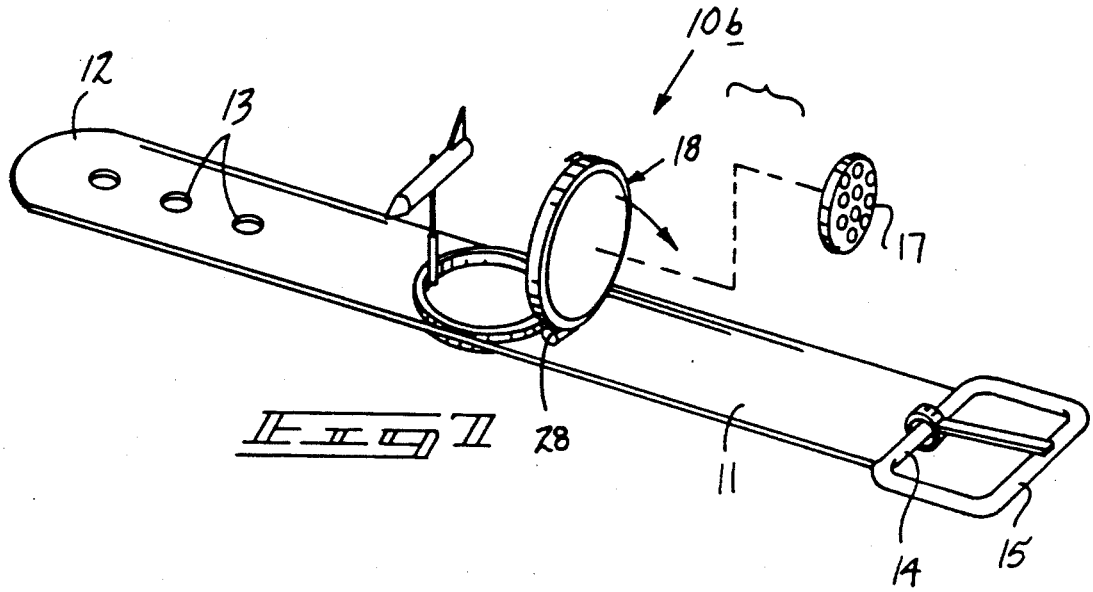
FIG. 7 is an isometric illustration of a modification of the invention.
Figure 8:
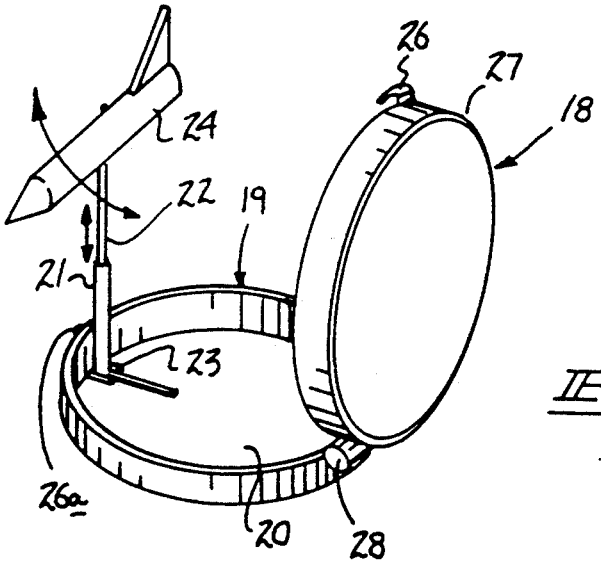
FIG. 8 is an enlarged isometric illustration of the magnetic housing structure, as set forth in FIG. 7.
Figure 9:
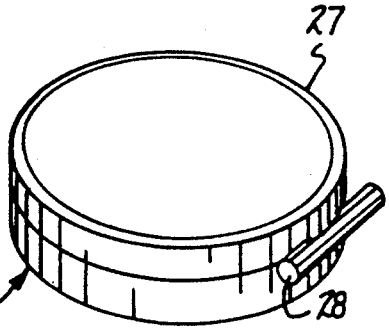
FIG. 9 is an isometric illustration of the modified housing structure in a closed configuration.

The FIGS. 7-9 illustrate the use of the web 11, including a modified magnetic housing 18. The modified housing 18 includes a housing base container 19 whose base container axial length defining an axial length of the base container is bisected by the web 11 to project the bottom surface of the base container 19 below the bottom surface of the web 11 for purposes as noted above. The base container 19 includes a base container floor 20 defined by a predetermined diameter pivotally mounting a tubular leg 21 about a spring hinge 23 that is arranged to bias the tubular first leg 21 in an orthogonal orientation relative to the floor 20 and wherein the first leg 21 telescopingly receives a second leg 22 that is arranged for frictional engagement interiorly of the first leg 21 to permit projection of the second leg in an extended orientation relative to the first leg. A wind vane 24 is orthogonally and rotatably mounted adjacent an upper terminal end portion of the second leg 22 and whose predetermined length is substantially equal to or less than the predetermined diameter to permit reception of the vane within the housing 18. It should be noted therefore that the length of the second leg 21 is also of a length less than the diameter of the housing 18 to permit the first leg 21 to be pivoted to a first position in contiguous communication with the floor 20, whereupon lifting of the housing lid 27 in a raised orientation, as illustrated in the FIGS. 7 and 8, permits pivotment of the vane 24 to the second position, as illustrated in the FIG. 8, in association with the first and second legs 21 and 22. A housing clasp structure 26 cooperates with a housing lug 26*a* for selective securement of the lid 27 relative to the base container 19. A hinge 28 pivotally mounting the lid 27 to the base container 19 is diametrically opposed to the clasp structure 26 and the lug 26*a* in use.

Figure 10:
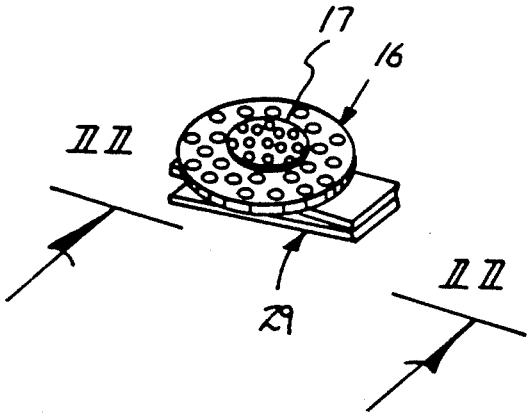
FIG. 10 is an isometric illustration of a further marker magnetic disc holder for securement to the strap structure.
Figure 11:
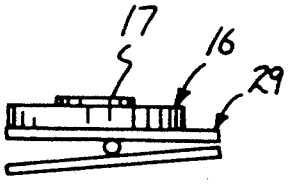
FIG. 11 is an orthographic view, taken along the lines 11—11 of FIG. 10 in the direction indicated by the arrows.
Figure 12:
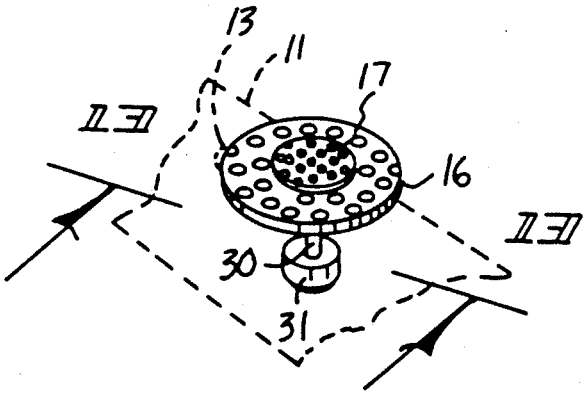
FIG. 12 is an isometric illustration of a pin support structure for mounting a magnetic housing thereon for selective securement to the strap structure.
Figure 13:
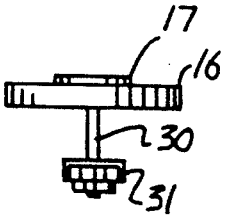
FIG. 13 is an orthographic side view, taken along the lines 13—13 of the pin structure as set forth in FIG. 12.

The FIGS. 10 and 11 illustrate the use of a spring clip 29 mounting a magnetic housing 16 and associated disc 17 thereon that may be in turn secured to the web 11 or subsequently to a garment of clothing to provide for additional marker structure. Further, if required, a post mount 30 may be projected through an available aperture 13 utilizing a connector 31 for securement adjacent the lower distal end of the post mount 30 for securing a further housing 16 of magnetic construction to also provide for securement of various disc structure 17 thereon.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A golf ball position marker apparatus, comprising, an elongate flexible web, the web including a web first distal end spaced from a web second distal end, the first distal end includes a plurality of apertures positioned adjacent the first distal end, with the apertures arranged at equal spacing relative to one another, and the apertures arranged in an aligned orientation relative to one another, wherein the aligned orientation bisects the first distal end, and the second distal end includes a fastening member for securement relative to the first distal end, and the web includes a ferromagnetic cylindrical housing medially mounted relative to the web, with the housing including a housing axis, the housing axis orthogonally oriented relative to the web, and the housing including a housing top surface and a housing bottom surface, the housing top surface including a ferrous metallic disc magnetically adhered to the housing top surface, and the housing includes a housing base container and a housing lid, with the housing lid hingedly mounted to the housing base container about a hinge member, and the housing base container axially bisected by the web, wherein the base container bottom surface defines the housing bottom surface, and wherein the housing bottom surface projects below a web bottom surface of the elongate web.

2. An apparatus as set forth in claim 1 wherein the housing base container includes a floor, and a first tubular leg pivotally mounted to the floor, with a spring hinge member pivotally mounting the lower distal end of the first leg to the floor to bias the first leg in a second position orthogonally oriented relative to the floor from a first position, wherein the first leg is arranged to overlie the floor, and the first leg includes a second leg frictionally and telescopingly mounted within the first leg, and the second leg includes a second leg upper distal end, and the second leg upper distal end includes a wind vane rotatably mounted adjacent the second leg upper distal end, and the wind vane is defined by a wind vane length and the container floor is defined by a predetermined diameter, wherein the wind vane length is less than the predetermined diameter to permit reception of the wind vane within the housing base container.

3. An apparatus as set forth in claim 2 wherein the lid includes a clasp member, and the base container includes a lug, wherein the clasp is selectively securable to the lug, and wherein the clasp and the lug are diametrically opposed relative to the hinge member.

* * * * *